US005353456A

United States Patent [19]

Evans

[11] Patent Number: 5,353,456

[45] Date of Patent: Oct. 11, 1994

[54] HEIGHT-ADJUSTABLE BEDSKIRT ASSEMBLY

[76] Inventor: Martha Evans, 1245 Ann Ave., Kansas City, Kans. 66102

[21] Appl. No.: 962,417

[22] Filed: Oct. 16, 1992

[51] Int. Cl.[5] ..... A47G 9/02

[52] U.S. Cl. ..... 5/493; 5/482; 5/486

[58] Field of Search ..... 5/482, 485, 486, 493, 5/496, 499, 500, 502

[56] References Cited

U.S. PATENT DOCUMENTS

| | | | |
|---|---|---|---|
| 2,763,875 | 9/1956 | Piontkowski | 5/493 |
| 4,587,683 | 5/1986 | Gardiner | 5/493 |
| 5,086,531 | 2/1992 | Carlos | 5/493 |
| 5,205,003 | 4/1993 | Green | 5/493 |

*Primary Examiner*—Michael F. Trettel

[57] ABSTRACT

A height-adjustable bedskirt assembly includes a generally rectangular support sheet having fasteners for adjustably coupling together a longitudinal fold in the sheet surface, and an elongate skirt. The support sheet includes fasteners which extend along the perimeter margin and engage similar fasteners which extend along the upper margin of the skirt, to permit easy removability of the skirt while the support sheet remains in place beneath the mattress. The support sheet includes a plurality of rows of spaced fasteners for adjustably coupling together a pair of longitudinal folds in the sheet surface. The support sheet also includes elastic keepers adjacent the corners for securing the support sheet to an underlying box spring.

9 Claims, 1 Drawing Sheet

HEIGHT-ADJUSTABLE BEDSKIRT ASSEMBLY

BACKGROUND OF THE INVENTION

1. Field of the Invention

The present invention relates to bedding, specifically to an improved design for a height-adjustable bedskirt assembly having a bedskirt removably coupled with an adjustable support sheet for quick, easy removal and replacement of the bedskirt. More particularly, it is concerned with a system having a support sheet fitted with a system of fasteners to permit width adjustment, the support sheet being fitted on the perimeter of three sides with a fastener for coupling with a bedskirt, and a bedskirt fitted at the top perimeter margin with a fastener. In preferred embodiments the support sheet includes a series of elastic keepers coupled adjacent the comers of the sheet for holding the sheet in place on a box spring mattress.

2. Description of the Related Art

The bedskirt, commonly referred to as a dust ruffle, has been in continuous use over many years. It is both utilitarian and decorative.

Conventional bedskirts are made of cloth and are designed to compliment bedroom decor and other bed clothes including sheets, comforters, quilts and bedspreads. The configuration of the skirt is substantially rectangular and it is generally constructed to hang from the box spring.

Previous bedskirt have sought to address the necessity of removing the mattress from the bed in order to care for the bedskirt and the necessity of washing or cleaning an entire bedskirt unit because the ruffle portion is permanently attached to other bed clothes.

Bed-making is a task generally performed by one person, often female. Removal of the mattress to install, change or remove the bedskirt is heavy duty work. More than one person is generally required to remove a king size mattress.

Manufacturers of beds and bedding have not yet adopted a universal standard with regard to height dimensions. The distance between the bottom of the mattress and the floor frequently varies from one bed to another. For example, the depth of commonly available box spring mattresses frequently varies between eight and nine inches. So-called "luxury" mattresses may be even deeper. Even shallower box springs are occasionally encountered. Similarly, bedskirt proportions often vary with respect to height. Consequently, it is often necessary to adjust the height of a bedskirt to accommodate the mattress for which it was purchased.

Previous bedskirt assemblies have generally failed to permit adjustment of the bedskirt to accommodate beds of different heights, as well as easy removal of the ruffle portion for laundering separately from the support member. U.S. Pat. No. 4,734,947 issued to Vitale discloses a bedskirt permanently attached to other fitted bedding components. In order to launder, dry clean or change the bedskirt, the mattress must first be removed and other pans of the unit must be removed as well. Similarly, when other pans of the unit require care, the bedskirt must be treated as well. U.S. Pat. No. 4,897,891 issued to Kallman, et al. discloses a unit which employs mesh screen, made of plastic affixed to both a box spring and a bed ruffle. The sides are joined by fastener pins. This system is exotic, labor intensive, and unnecessarily costly. U.S. Pat. No. 5,086,531 issued to Carlos discloses a bedskirt fastened between a fitted support sheet and a u-shaped strip. The u-shaped strip constitutes an additional, superfluous layer, whereby adding to the cost of manufacturing. U.S. Pat. No. 4,587,683, issued to Gardiner discloses a unit employing a zipper which restricts exchangeability to products equipped with a similar fastener.

SUMMARY OF THE INVENTION

The present invention overcomes the problems previously outlined and provides a greatly improved bedskirt assembly which permits adjustment of the height of the skirt as well as quick and easy removal and replacement of the skirt without disturbing the remainder of the bed clothes.

Broadly speaking, the bedskirt assembly includes a generally rectangular support sheet having fasteners for adjustably coupling together a longitudinal fold in the sheet surface, and an elongate skirt. The support sheet includes fasteners which extend along the perimeter margin and engage similar fasteners which extend along the upper margin of the skirt, to permit easy removal of the skirt while the support sheet remains in place beneath the mattress. In particularly preferred forms, the support sheet includes a plurality of rows of spaced fasteners for adjustably coupling together a pair of longitudinal folds in the sheet surface. In other preferred forms, the support sheet includes elastic keepers adjacent the corners for securing the support sheet to an underlying box spring.

OBJECTS AND ADVANTAGES OF THE INVENTION

The principal objects and advantages of the present invention include: providing a bedskirt assembly which permits adjustment of the height of a removable skirt; providing such a system which permits adjustably coupling together a longitudinal fold in a support sheet removably coupled with a decorative skirt; providing such a system which permits easy removal and replacement of the skirt without the need for removing the support member or disturbing the other bed clothes; providing such a system which permits replacement of the skirt without the need for removing the mattress; providing such a system which couples a removable skirt to the perimeter margin of a support sheet which underlies a top mattress; providing such a system in which a generally rectangular support sheet is held securely in place by elastic keepers adjacent the corners so that extension of the support sheet over the sides or beneath the box spring is not required; providing such a system which minimizes the mount of fabric support sheet required; providing such a system which is economical to produce; providing such a system in which the components are interchangeable.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 1:
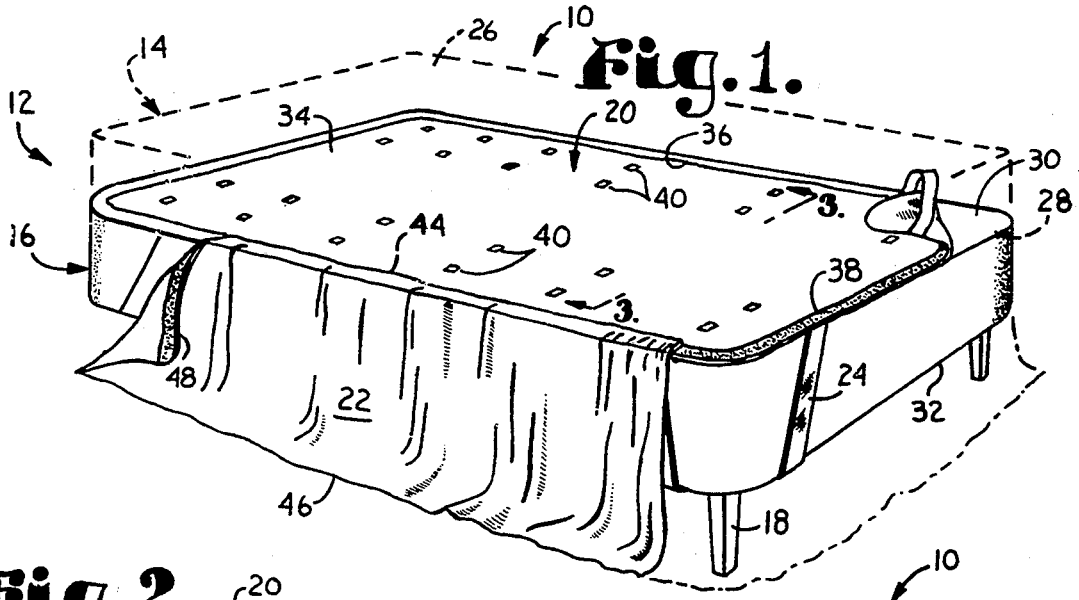
FIG. 1 is a perspective view with parts broken away showing the adjustable bedskirt assembly of the invention installed on a mattress and box spring, with the bedskirt partially uncoupled from the support sheet.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and is a representative basis for teaching one skilled in the art to variously employ the present invention in virtually any appropriately detailed structure.

Referring now to the drawing, a bedskirt assembly 10 in accordance with the invention is shown installed on the lower portion of a bed 12 comprising a mattress 14, box spring 16 and legs 18, and broadly includes a support sheet 20, skirt 22, and four keepers 24.

Figure 2:
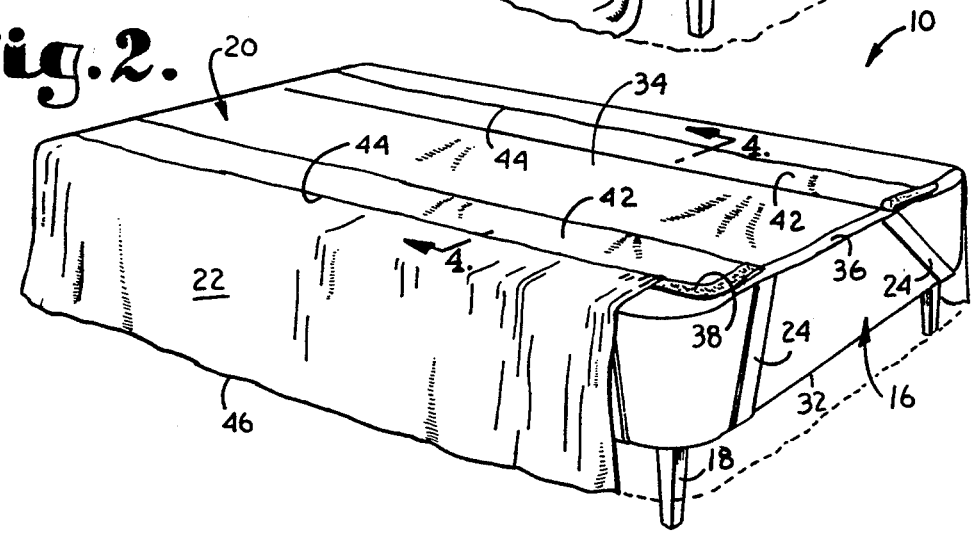
FIG. 2 is a perspective view similar to that depicted in FIG. 1, showing longitudinal folds in the support sheet surface to raise the height of the bed ruffle relative to the floor surface.

In more detail, mattress 14 is of conventional construction and includes upper and lower surfaces 26, 28. Similarly of conventional construction, box spring 16 includes upper and lower surfaces 30, 32. Generally rectangular support sheet 20 includes an upper surface 34 and a perimeter margin 36 equipped with fasteners 38 along the side and foot portions of the margin. As best shown in FIGS. 1 and 2, upper surface 34 includes longitudinal rows of spaced fasteners 40 for securing longitudinal folds 42. Support sheet 20 may be constructed of any durable material such as a woven fabric like duck cloth or any other suitable material. A hem of about one inch to about two inches may be formed at perimeter margin 36.

Fasteners 38, 40 are preferably of hook and loop construction of any suitable width, although a number of other types of fasteners may be employed. Advantageously, the components of such hook and loop fasteners may be interchangeably intercoupled with the respective components of hook and loop fasteners of virtually any size, color or manufacture. Support sheets 20 and skirts 22 can thus be single item purchases. Rows of fasteners 40 are located near the support sheet perimeter margin 36, preferably at a distance of from about eight inches to about twelve inches from margin 36, although they may also be centrally spaced to permit fastening of a single, central longitudinal fold 42. In preferred forms short lengths of fastening material are employed at spaced intervals of about fifteen to about eighteen inches along the length of the support sheet. Keepers 24 are fixedly coupled with support sheet perimeter margin 36 at spaced intervals adjacent the corners to form depending loops for receiving the respective corners of box spring 16. Keepers 24 are preferably constructed of bands of elastic material, of about two inches in width.

Elongate, generally rectangular skirt 22 includes an upper margin 44 and a lower margin 46. Upper margin 44 is equipped with fasteners 48 for mating engagement with support sheet perimeter margin fasteners 38. Skirt 22 is preferably constructed of decorative fabric which may be cleaned by laundering, although other forms may require dry cleaning.

In use, a support sheet 20 is installed on a box spring 16 in overlying relationship, by extending each of the four elastic keepers 24 around a respective corner of box spring 16 until the keeper contacts box spring lower surface 32. Support sheet 20 is installed with upper surface 34 contacting mattress lower surface 28, so that perimeter margin fasteners 38 face upwardly, toward mattress lower surface 28. A mattress 14 is placed atop the box spring 16 and support sheet 20. Such placement between mattress 14 and box spring 16 protects support sheet 20 against soil and wear.

Figure 4:
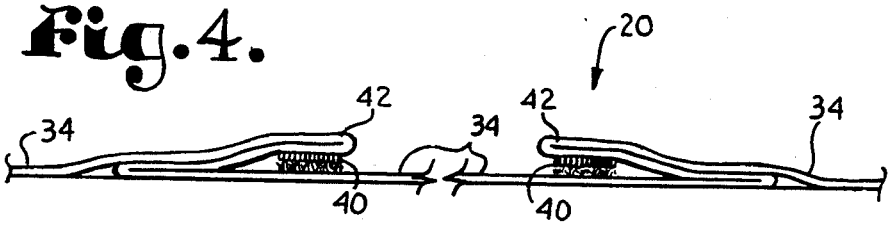
FIG. 4 is an enlarged sectional view taken along line 4—4 of FIG. 2, showing fasteners engaged to secure longitudinal folds in the support sheet surface.
Figure 3:
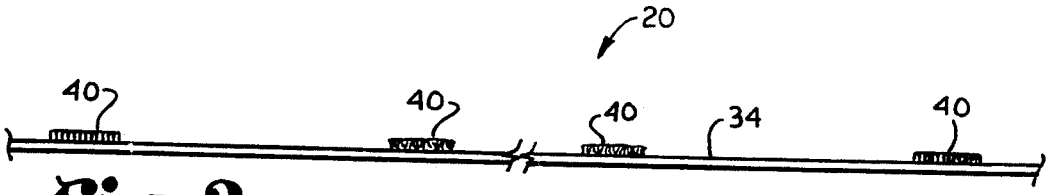
FIG. 3 is an enlarged sectional view taken along line 3—3 of FIG. 1, depicting spaced fasteners attached to a support sheet surface.

A user attaches the skirt 22 to the support sheet 20 by grasping the skirt with upper margin 44 uppermost and with skirt fasteners 48 facing toward the bed 12 and couples skirt fasteners 48 with support sheet fasteners 38. This bond will firmly hold the skirt 22 to the support sheet 20. As best shown in FIGS. 3 and 4, if the skirt depends downwardly onto the floor surface or sags in places, the user intercouples support sheet surface fasteners 40 in the appropriate area to form one or more folds in the support sheet 20, each fold 42 measuring, for example, about three inches in width. Formation of the folds shifts the skirt upper margin 44 inwardly, towards the center of the box spring 16 to adjust the width of the support sheet 20 and effectively shorten the hanging length of the skirt until it clears the floor surface.

Periodically, it may be desirable to remove skirt 22 for cleaning or replacement with a skirt of a different decorative pattern or color. Advantageously, in such instances it is not necessary to remove support sheet 20 or mattress 14. A user merely grasps a comer of the skirt upper margin and disengages skirt fasteners 48 from support sheet perimeter fasteners 38 in a peeling motion. A replacement skirt may then be installed by coupling the fasteners 48 of the replacement skirt with support sheet fasteners 38 as previously described. If the replacement skirt is then too short, surface fasteners 40 may be uncoupled to release folds 42.

I claim:

1. An adjustable bedskirt assembly for use beneath a mattress on a bed, comprising:

(a) a generally rectangular support sheet presenting a top surface and a perimeter margin, said perimeter margin including coupling means;

(b) an elongate ruffle presenting upper and lower margins, said upper margin including coupling means for removably coupling said ruffle with said support sheet perimeter margin in a depending relationship between said mattress and a floor surface;

(c) said support sheet top surface including coupling means for adjustably coupling together a longitudinal fold in said sheet surface for varying the height of said bed ruffle relative to said floor surface.

2. The apparatus as set forth in claim 1 wherein said support sheet coupling means includes a plurality of longitudinal rows of spaced fasteners for coupling together a pair of longitudinal folds in said sheet surface.

3. The apparatus as set forth in claim 1, wherein said mattress presents upper and lower surfaces and said support sheet engages substantially the entire lower surface of said mattress.

4. The apparatus as set forth in claim 1, wherein said bed further includes a mattress and a box spring, each presenting upper and lower surfaces, and a frame, said dust ruffle being positioned between said mattress lower surface and said box spring upper surface.

5. The apparatus as set forth in claim 4, wherein said bedskirt assembly further includes means for maintaining said support sheet in place on said box spring.

6. The apparatus as set forth in claim 5 wherein said means for maintaining said support sheet in place includes a plurality of elastic bands.

7. An adjustable bedskirt assembly for use between a mattress and a box spring mattress on a bed, comprising:

(a) a generally rectangular support sheet presenting a top surface, and a perimeter margin, said perimeter margin including coupling means;

(b) means for maintaining said support sheet in place between said mattress and said box spring;

(c) an elongate ruffle presenting upper and lower margins, said upper margin including coupling means for removably coupling said ruffle with said support sheet perimeter margin in a depending relationship between said mattress and a floor surface; and (d) said support sheet top surface including coupling means for adjustably coupling together a longitudinal fold in said sheet surface for varying the height of said bed ruffle relative to said floor surface.

8. The apparatus as set forth in claim 7 wherein said means for maintaining said support sheet in place includes a plurality of elastic bands.

9. The apparatus as set forth in claim 7 wherein said support sheet coupling means includes a plurality of longitudinal rows of spaced fasteners.

* * * * *